US005775524A

United States Patent [19]

Dunham

[11] Patent Number: 5,775,524

[45] Date of Patent: Jul. 7, 1998

[54] REMOTE UNCOUPLING MECHANISM

[75] Inventor: Michael Nathan Dunham, Eagle Point, Oreg.

[73] Assignee: Kadee Quality Products Co., White City, Oreg.

[21] Appl. No.: 621,505

[22] Filed: Mar. 25, 1996

[51] Int. Cl.[6] ..... B61G 7/00

[52] U.S. Cl. ..... 213/75 TC

[58] Field of Search ..... 213/75 TC, 159, 213/161, 162, 211, 212, 217

[56] References Cited

U.S. PATENT DOCUMENTS

| | | | |
|---|---|---|---|
| 2,223,905 | 12/1940 | Beyer et al. | 213/212 |
| 2,297,143 | 9/1942 | Giaimo | 213/75 TC |
| 2,303,731 | 12/1942 | Ferri | 213/75 TC |
| 2,658,629 | 11/1953 | Pettit | 213/75 TC |
| 3,583,574 | 6/1971 | Herbert | 213/212 |
| 3,690,469 | 9/1972 | Nagoya et al. | 213/212 |
| 3,724,680 | 4/1973 | Hines | 213/212 |
| 3,939,989 | 2/1976 | Thomson | 213/75 TC |
| 4,219,123 | 8/1980 | Saeki | 213/75 |
| 4,335,820 | 6/1982 | Gramera | 213/75 |
| 4,927,035 | 5/1990 | Geng et al. | 213/75 |
| 5,050,505 | 9/1991 | Konno | 104/295 |
| 5,152,410 | 10/1992 | Ta et al. | 213/212 |
| 5,251,856 | 10/1993 | Young et al. | 246/187 A |
| 5,423,439 | 6/1995 | Richter | 213/75 |
| 5,511,749 | 4/1996 | Horst et al. | 246/187 A |

*Primary Examiner*—Mark T. Le
*Attorney, Agent, or Firm*—Robert D. Varitz

[57] ABSTRACT

A model railroad remote uncoupler mechanism is intended for use with a signal-receiving mechanism and a self-centering coupler. A coupler is mounted on a unit of model railroad rolling stock, and is shiftable between a coupled condition, wherein the coupler engages a coupler on another unit of rolling stock, in an uncoupled condition. The remote uncoupler mechanism includes an electromotive actuator, which is activated by the signal-receiving mechanism, and a connector, which extends between the electromotive actuator and the coupler for shifting the coupler between its coupler position and its uncoupled condition. A power supply is provided for the remote uncoupler mechanism, which power supply may be carried on-board the rolling stock, or may include a pick-up mechanism for collecting power from the energized rails of the model railroad layout.

10 Claims, 6 Drawing Sheets

REMOTE UNCOUPLING MECHANISM

FIELD OF THE INVENTION

The invention relates to model railroad rolling stock, and specifically to a remote uncoupling mechanism for use on model railroad rolling stock.

BACKGROUND OF THE INVENTION

Model railroads are constructed to be as close to prototype railroads as possible. To this end, considerable effort is expended in the modelling of engines and rolling stock, which are precise scale models of prototypical railroading equipment. As is to be expected, however, it is not possible to accurately duplicate every feature of a prototypical railroad in a model railroad. Once models are made, considerable effort is made to run model trains as close as possible to their prototypical inspirations. Model railroad clubs will have layouts of rather grand scales, will provide dispatchers, engineers, yard supervisors and railroad workers, complete with communications equipment, to mimic the operation of a prototypical railroad. While such effort is laudable, and provides a welcome escape from day-to-day life, the operation of the models is still not precisely like the prototype railroads. One of the major problem areas in model railroad operation involves the formation of and the breaking-down of trains, particularly, the coupling and uncoupling of rolling stock units into trains, and the rearrangement of rolling stock within a train.

In a prototype railroad, a conductor is responsible for supervising the addition of cars (rolling stock) to a train. The conductor is also responsible for taking cars out of a train. This may involve the manual operation of couples which are located on the ends of cars, or may simply involve the supervision of automated train formation and break-down equipment. In the case of the manual operation, the conductor physically operates the couples, and signals the engineer where the locomotive, and the cars attached thereto are to move. Cars may be disconnected from the train at any point along the track, and may be picked up from any point along the track. Model railroads have been limited in train building and breaking because the couplers manufactured for use on model trains, while somewhat prototypical in operation, are not provided with scale conductors to perform the coupling and uncoupling operations along the track.

A variety of coupler types are known for use with model railroads. Some trains are "built" with non-operating couplers, which will remain permanently joined to one another, thereby forming a train with a number of cars therein, which is always run as a unit. One type of frequently used operating coupler is the National Model Railway Association (NMRA) hook-and-horn coupler, which will automatically couple two units of rolling stock together when the couplers on the rolling stock units are pushed into one another, either manually, or by a model locomotive. Special uncoupling ramps must be provided to uncouple these couplers, which ramp includes an insert, which is located between the rails of model railroad track, and a pair of spaced apart wires, which extend above the insert and which will serve to uncouple two units of rolling stock when the couplers on the rolling stock are backed through the wires. The NMRA hook-and-horn coupler, and its associated uncoupling ramp, is not prototypical, and detracts from the realism of model railroad operation.

Another type of coupler which is used in model railroad rolling stock is the Magne-Matic® coupler which is manufactured by Kadee Quality Products Company and Micro-Trains Lines Co. The Magne-Matic® coupler closely resembles a prototypical coupler in that it is able to be remotely coupled and uncoupled. Known uncoupling devices for the Magne-Matic® coupler include an uncoupling ramp, which is a bar magnet, and which may be placed in between the rails of the model railroad track. Alternately, an electromagnetic uncoupling ramp may be placed beneath the support for the track, which will enable an operator to remotely uncouple rolling stock which is located over the uncoupling ramp. A number of other companies make uncouplers similar to the Magne-Matic® coupler, which provide varying degrees of performance.

Even in the case of the Magne-Matic® coupler, a model railroader is limited as to where uncoupling may take place, in that a fully automatic uncoupling operation may occur only over an uncoupling ramp. A number of hand-held devices are available which enable an operator to manually uncouple rolling stock by inserting a pair of spaced-apart, opposed magnets between two pieces of rolling stock, which magnets will cause the Magne-Matic® couplers to uncouple. This may be realistic in the sense that prototypical railroads require human intervention to uncouple the cars, however, in the case of model railroads, the presence of a "giant conductor" on the layout is not prototypical. In many instances, it may be desired to uncouple cars in an area that is not easily reachable by a model railroader.

SUMMARY OF THE INVENTION

Accordingly, it is an object of the invention to provide a model railroad remote uncoupler mechanism which may be used at any position on a model railroad layout.

Another object of the invention is to provide a remote uncoupler mechanism which is usable with existing model railroad coupler.

A further object of the invention is to provide a remote uncoupler mechanism which may be retro-fitted into existing pieces of rolling stock.

Yet another object of the invention is to provide a remote uncoupler mechanism which provides realistic operation of a coupler mounted on a model railroad rolling stock.

The model railroad remote uncoupler mechanism of the invention is intended for use with a signal-receiving mechanism and a self-centering coupler. A coupler is mounted on a unit of model railroad rolling stock, and is shiftable between a coupled condition, wherein the coupler engages a coupler on another unit of rolling stock, in an uncoupled condition. The remote uncoupler mechanism includes an electromotive actuator, which is activated by the signal-receiving mechanism, and a connector, which extends between the electromotive actuator and the coupler for shifting the coupler between its coupler position and its uncoupled condition. A power supply is provided for the remote uncoupler mechanism, which power supply may be carried on-board the rolling stock, or may include a pick-up mechanism for collecting power from the energized rails of the model railroad layout.

These and other objects and advantages of the invention will become more fully apparent as the description which follows is read in connection with the drawings.

BEST MODE OF PRACTICING THE INVENTION

Figure 1:
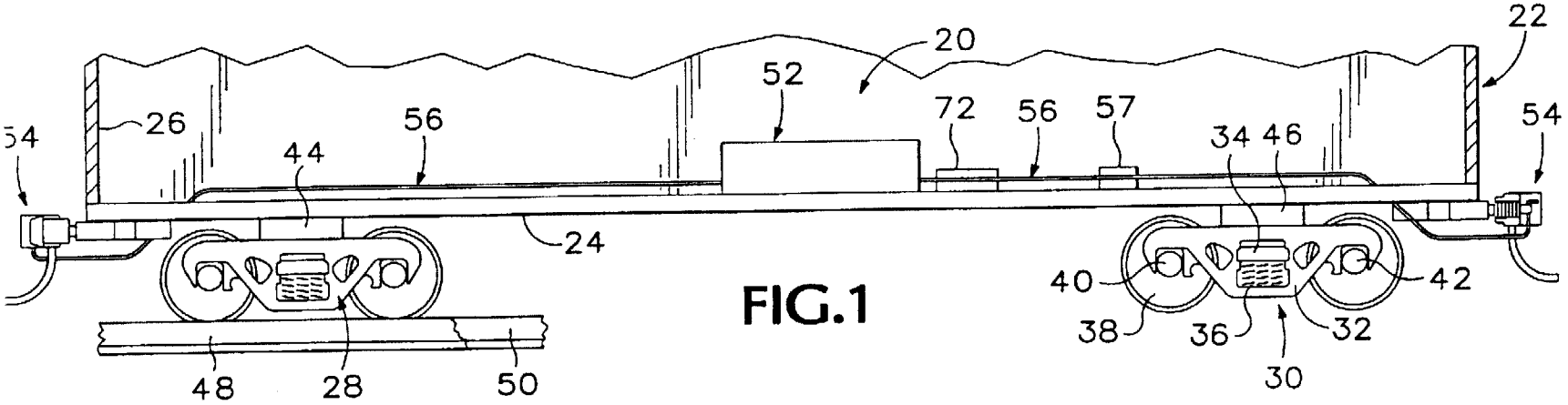
FIG. 1 is a side elevation of a model railroad rolling stock unit depicting the remote uncoupler mechanism of the invention.
Figure 2:
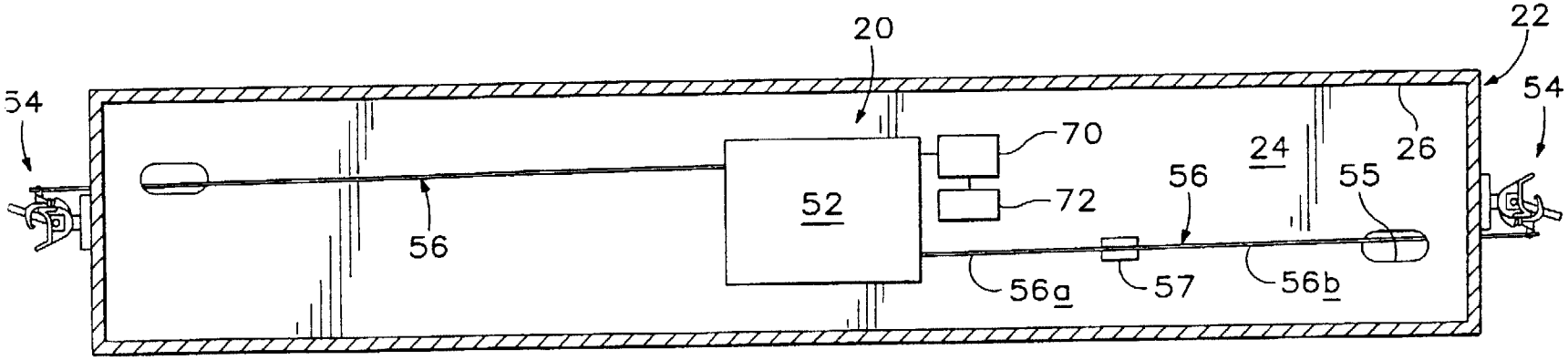
FIG. 2 is a top plan view of the model railroad rolling stock of FIG. 1.

Referring initially to FIGS. 1 and 2, a model railroad remote uncoupler mechanism constructed according to the invention is depicted generally at 20. Uncoupler mechanism 20 is mounted in a model railroad rolling stock unit 22. Rolling stock unit 22 includes an undercarriage 24, a body 26, portions of which are broken away to show detail of the invention, and a pair of trucks 28, 30, located adjacent each end of undercarriage 24. Trucks 28 and 30 each include a side frame 32, a bolster 34, springs 36, and wheels 38, which are mounted on axles 40. Axles 40 are mounted in journals 42 which are located at either end of side frame members 32. Trucks 28 and 30 are mounted to undercarriage 24 by means of truck mounts 44, 46, respectively. Rolling stock unit 22 moves on spaced apart rails 48, 50, which rails may be energized by an electric current.

Uncoupler mechanism 20 includes an electromotive actuator 52 which is connected to a coupler 54, located on each end of rolling stock unit 22, by a connector 56. Connector 56 extends, in the preferred embodiment, along the upper surface of undercarriage 24, passes through a connector passage 55 to the underside of undercarriage 24, and is attached to coupler 54. Connector 56 is operable to shift coupler 54 between its coupled condition, as depicted in FIGS. 1, 2, 5, 6, and an uncoupled condition, depicted in FIG. 8. Connector 56 may be divided into connector portions **56*a*, and 56*b*, which connector portions are joined by a flexible link, shown generally at 57, which provided free movement to coupler 54. Flexible link 57** will be described in more detail later herein.

In general, the electromotive actuator of the invention activates connectors 56 with a motive force provided by a prime mover in the electromotive actuator. The prime mover may take a variety of forms, and may include a solenoid or a shape-memory alloy wire. In either form, the prime mover causes a pivot arm to rotate about a pivot point, between two stops. The connectors are attached at each end of the pivot arm, and extend to the coupler(s) on an end of the rolling stock unit. A signal-receiving mechanism is attached to a power supply for the prime mover. Upon receipt of a signal, the signal-receiving mechanism generates a trigger signal, which trigger signal causes the prime mover to be powered, thereby moving the pivot arm, and moving the coupler(s) to an uncoupled condition.

Figure 3:
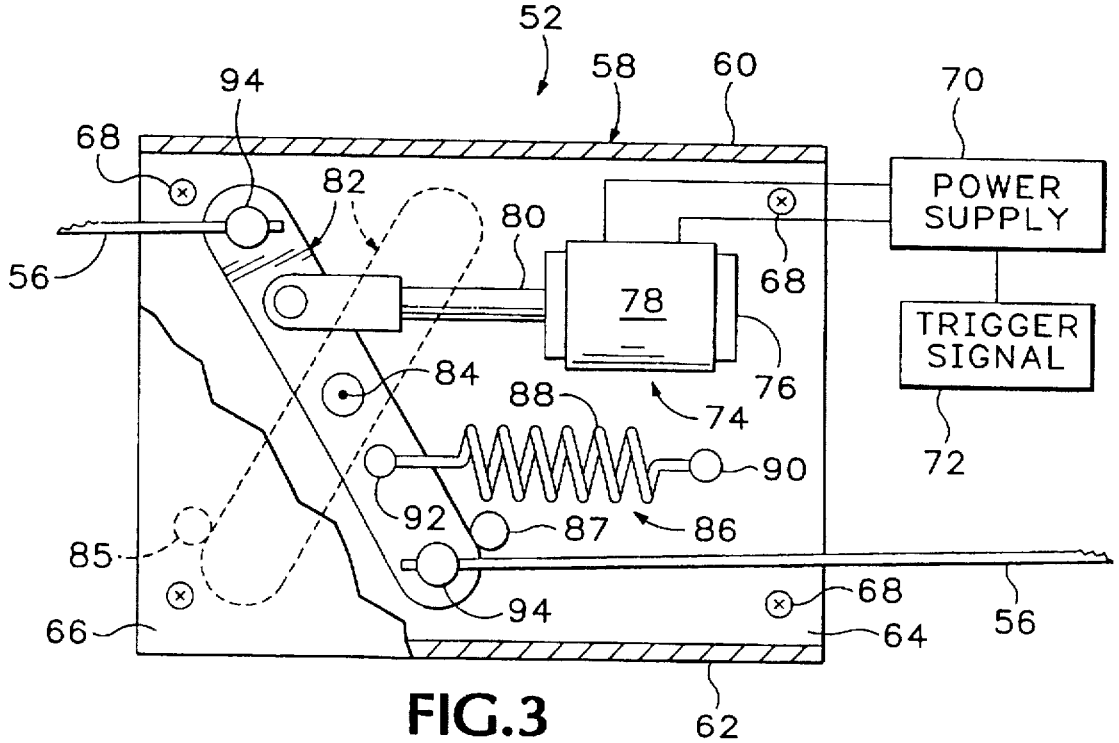
FIG. 3 is a top plan view of a first embodiment of the electromotive actuator of the invention.

Referring now to FIG. 3, a first embodiment of electromotive actuator 52 is depicted. Actuator 52 includes a case 58 which includes sides 60, 62, a base 64 and a top 66. Case 58 is secured to undercarriage 24 by means of fasteners 68. A power supply 70 is connected to actuator 52, which power supply is connected to a signal-receiving mechanism 72, which is operable to provide a trigger signal to power supply 70. Power supply 70 and signal-receiving mechanism 72 will be described in greater detail later herein. At this point, it is sufficient to identify power supply 70 as being sufficient to provide power to a prime mover 74 in the electromotive actuator. In this particular embodiment, prime mover 74 includes a solenoid, having a solenoid core 76, a winding 78 and a solenoid rod, or armature, 80.

Solenoid rod 80 is connected to a pivot arm 82, which pivots about a pivot point 84. As depicted in FIG. 3, pivot arm 82 is shown (in solid lines) in a second, coupling position, and is depicted (in dashed lines) in a first, uncoupling position. Electromotive actuator 52 includes a biasing mechanism 86 which is operable to bias pivot arm 82 into its second, coupling position. In this embodiment of the invention, biasing mechanism 86 includes a spring 88, which is fixed at one end thereof to a post 90 secured to electromotive actuator base 64, and secured at the other end thereof to a post 92 which is carried on pivot arm 82. Pivot arm 82 is free to pivot about pivot point 84 within limits defined by stops 85 and 87. Connectors 56 are attached to pivot arm 82 by means of connector attachments 94 which are located on either end of pivot arm 82.

Figure 6:
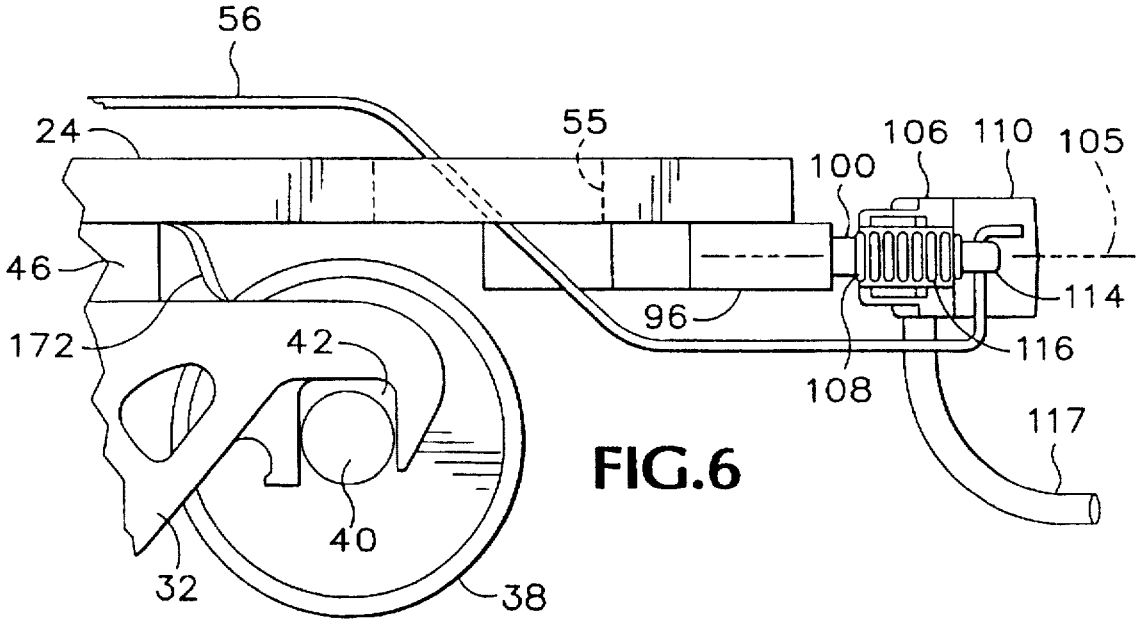
FIG. 6 is an enlarged side elevation of a coupler and a connector of the invention.
Figure 7:
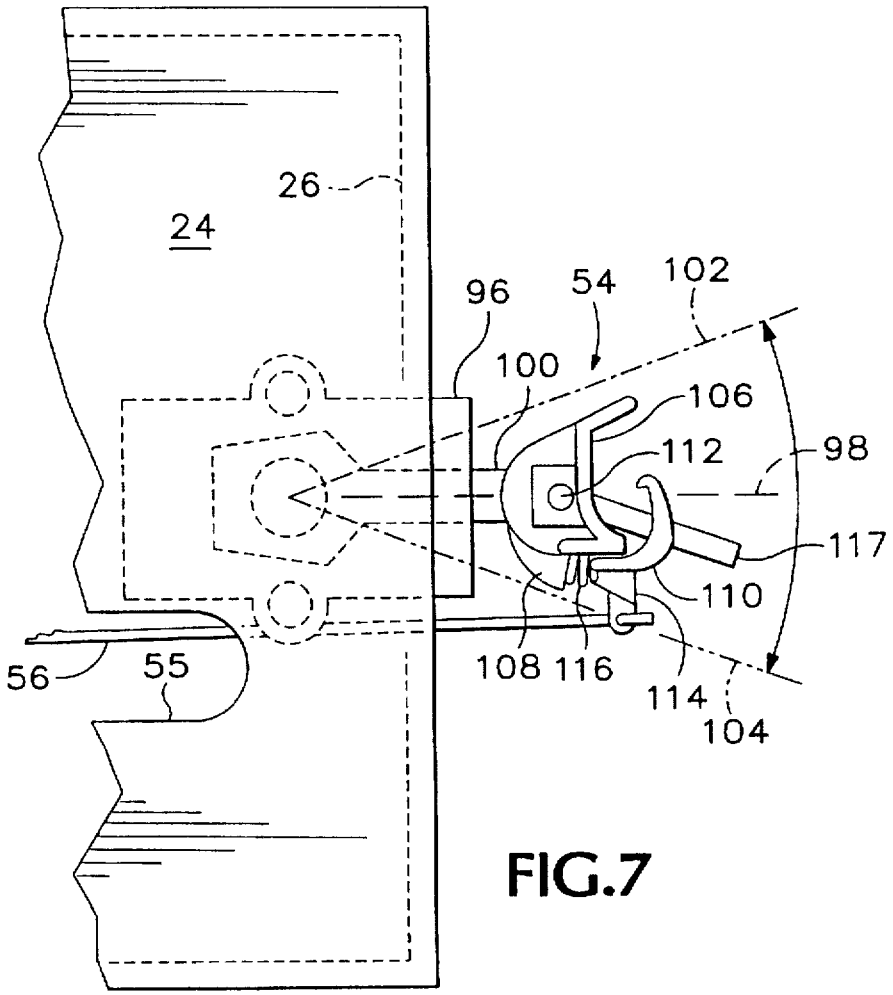
FIG. 7 is a top plan view of the coupler and connector of FIG. 6.

Referring now to FIGS. 2, 6 and 7, the connection between electromotive actuator 52 and coupler 54 will be described in greater detail. As previously noted, coupler 54 is self-centering. Coupler 54 is mounted in a draft box 96 which is secured to, or which may be integrally formed with undercarriage 24. Draft box 96 includes a spring mechanism (not shown) therein, which maintains coupler 54 in a centered position, represented by dashed line 98 in FIG. 6. Coupler 54 includes a coupler shank 100, which extends into draft box 96, and is pivotally mounted therein, for swinging movement in a pre-defined arc, the horizontal limits of which are indicated by the dash-dot line 102, dash-double-dot line 104. Dash-triple-dot line 105 depicts the horizontal plane of the pre-defined arc. Coupler 54 further includes a coupler head 106, which includes a structure known as a head dog 108, and a coupler knuckle 110, which is mounted on coupler head 106 for pivoting movement relative thereto about a pivot 112 and which has a structure known as a knuckle dog 114 located thereon. As previously noted, connector 56 extends from pivot arm 82 along the upper surface of undercarriage 24 to a connector passage 55, where it passes to the underside of undercarriage 24 and is attached to knuckle dog 114. Connector 56 is attached to knuckle dog 114 in the preferred embodiment of the invention. In the case of the NMRA hook-and-horn coupler, connector 56 may be attached anywhere on the coupler which will result in the coupler shifting to its uncoupled condition upon the application of power to prime mover 74.

A biasing mechanism 116 extends between head dog 108 and knuckle dog 114 and biases knuckle 110 to a closed position, as depicted in FIG. 7. The usual form of biasing mechanism 116 in the Magne-Matic® coupler is a coil spring, although other forms of biasing mechanisms have been used in a other couplers. The coil spring has proved itself to be a preferred form of biasing mechanism for many years. An air hose 117 extends below coupler 54 and serves as both a pivot mechanism for the knuckle relative to the head, and also serves as the magnetic portion of the couple, which acts to shift the knuckle to its open position in the presence of an appropriate magnetic field.

Figure 8:
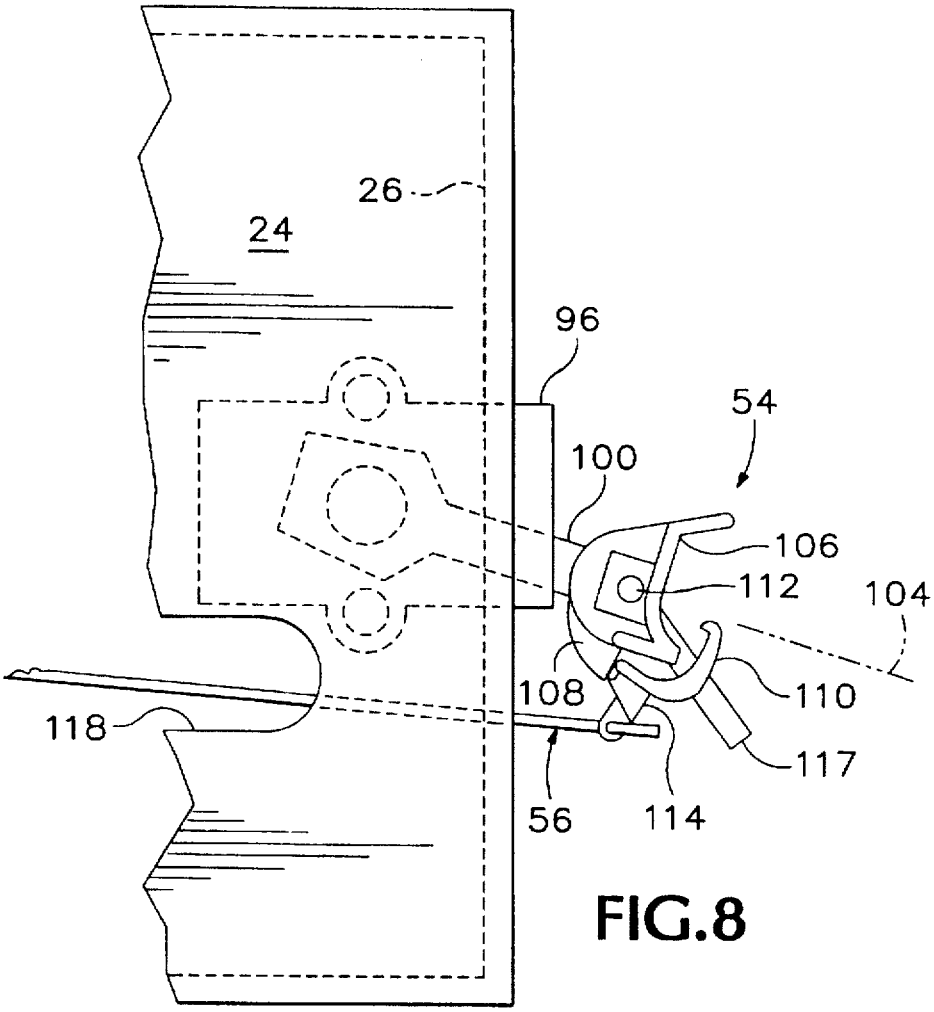
FIG. 8 is an top plan view of the coupler of FIG. 7 in an uncoupled condition.

As depicted in FIG. 8, coupler 54 is depicted in an uncoupled condition with knuckle 110, shown in an open position. With coupler 54 configured as depicted in FIG. 8, the coupler is operable to disengage a like coupler on another rolling stock unit, thereby uncoupling the units from one another. Such an uncoupling operation may take place at any location on the model railroad layout, and is not limited to occurring over a special uncoupling ramp.

Although the operation of uncoupling mechanism 20 will be described in greater detail later herein, it should be apparent that activation of prime mover 74 results in the shifting of connectors 56 and, in turn, the shifting of coupler 54 and coupler knuckle 110 from their respective coupled condition and closed position, depicted in FIG. 7, to the uncoupled and open position, depicted in FIG. 8. With relaxation of prime mover 74, biasing mechanism 86 returns pivot arm 82 to its second, uncoupled condition, which in turn allows the centering mechanism for coupler 54 and biasing mechanism 116 to return coupler components to their coupled, closed position. Although the electromotive actuator of the invention is depicted herein as having connectors extending to both end of a rolling stock unit, it should be appreciated that a single connector may extend to one end of a rolling stock unit. Such a configuration would be used in the case of a steam locomotive and tender, which are always joined to one another. It may be advantageous to provide a number of "remote uncoupler" cars on a layout, which cars may be permanently attached to a train at one end thereof, and which enable the train to be separated from a locomotive or from another train. Such "remote uncoupler" cars may bear special markings for easy identification. In the case of a diesel locomotive, a remote uncoupler may be provided at one or both ends thereof.

Figure 5:
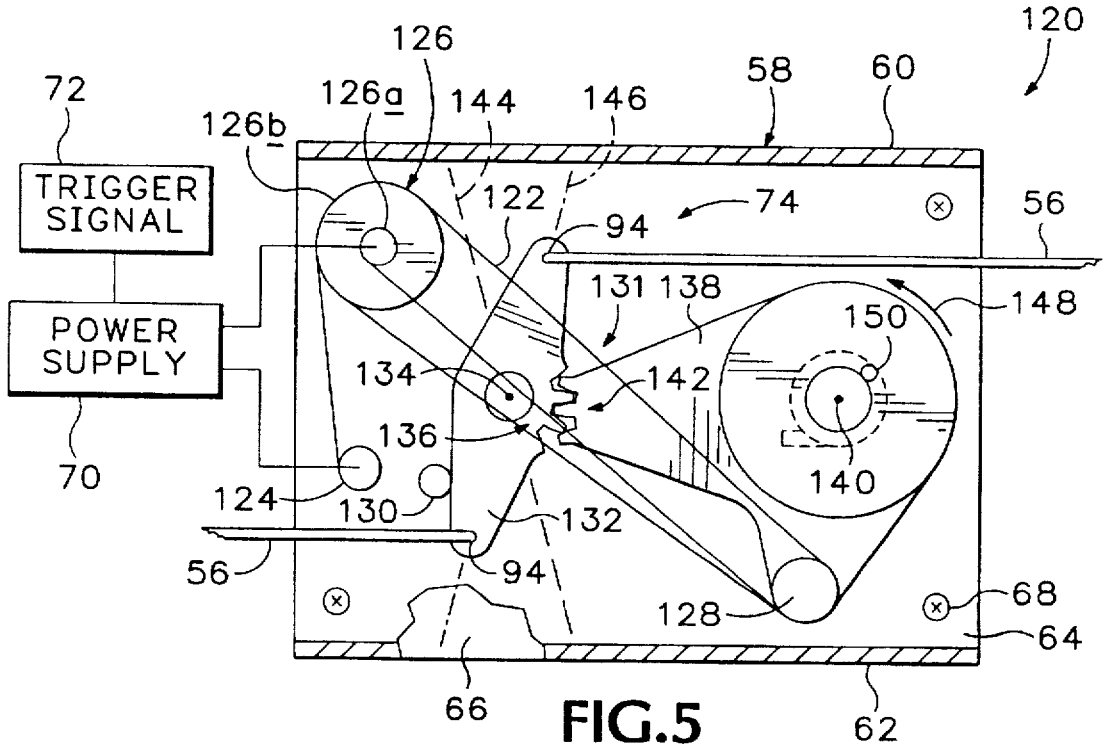
FIG. 5 is a top plan view of the actuator of FIG. 4.
Figure 4:
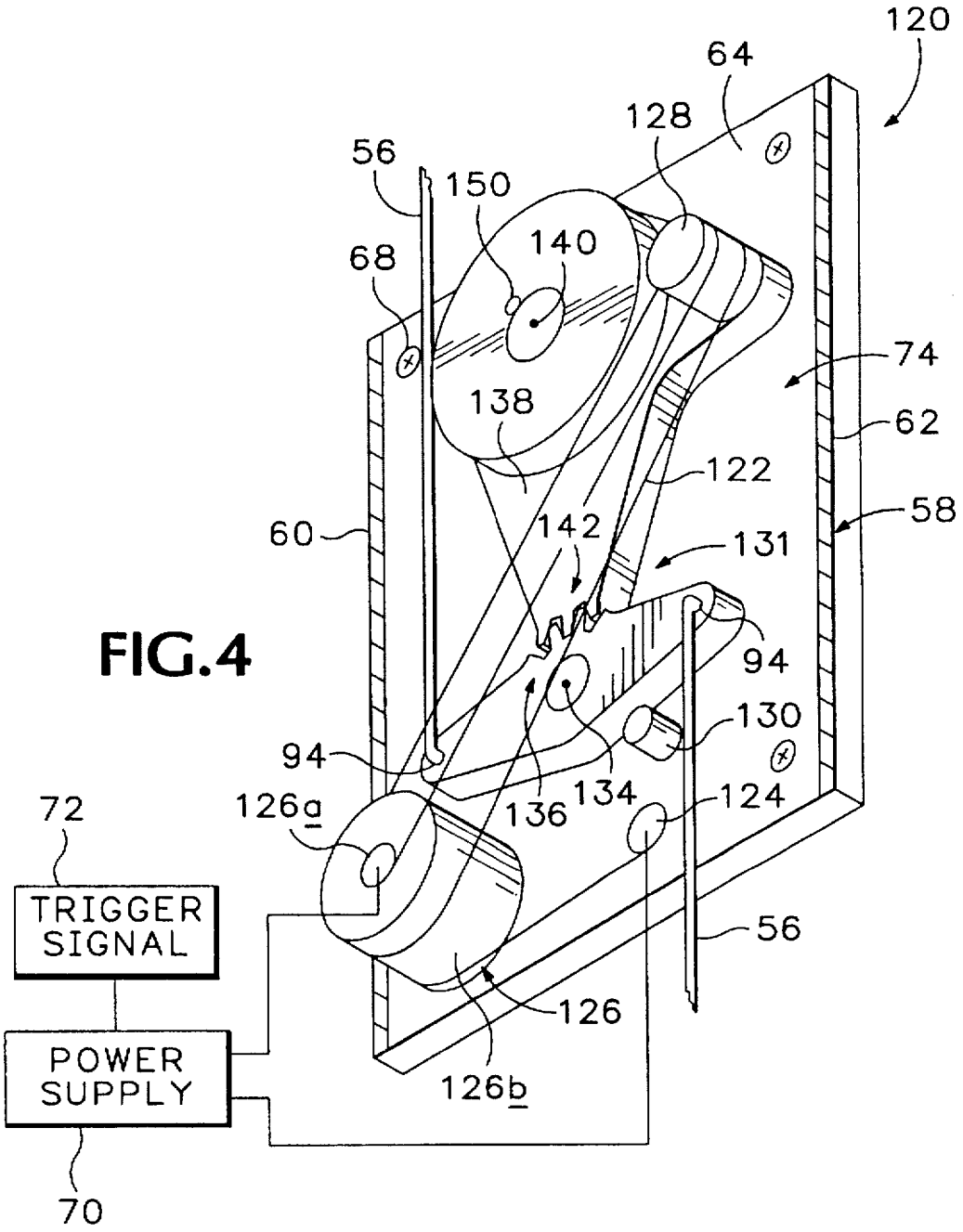
FIG. 4 is a perspective view of a second embodiment of the electromotive actuator of the invention.

Turning now to FIGS. 4 and 5, a second embodiment of the electromotive actuator is depicted at 120. Where there are like components in electromotive actuator 120 and electromotive actuator 52, like reference numbers have been used. The prime mover in electromotive actuator 120 includes a shape-memory alloy, which is depicted as a wire at 122, which is attached to an anchor point 124, and is then trained about alloy-training posts 126 and 128. A stop post 130 is provided on base 64 of actuator 120. Post 126 has a first, electrically conductive portion 126*a* and a second, electrically non-conductive portion 126*b*. Shape-memory alloy 122 changes shape about the alloy-training posts when an electrical current is applied thereto. In the preferred embodiment, shape-memory alloy 122 is a nickel-titanium wire (Ni-Ti). Wire 122 is fixed at its ends to anchor point 124 and alloy-training post 126*a*, and is movable about alloy training posts 126*b* and 128. As is seen in FIGS. 4 and 5, the path of alloy 122 commences at anchor point 124, extends about portion 126*b*, extends to post 128, returns to post 126*b*, is trained in another turn about post 128, and is secured to portion 126*a*. In this configuration, wire 122 contracts along its entire length when powered.

Electromotive actuator 120 includes a pivot arm mechanism 131, which includes a first pivot arm 132, which pivots about a pivot point 134, and which includes a number of gear teeth, shown at 136. A second pivot arm 138 pivots about a pivot point 140 and includes a number of teeth, shown at 142, which mesh with teeth 136. Alloy-training post 128 is mounted on second pivot arm 138. The relative lengths of the teeth-bearing portions of first pivot arm 132 and second pivot arm 138 provide a multiplier effect, i.e., a slight movement in second pivot arm 138 will result in a larger movement of first pivot arm 132. As depicted in FIG. 5, first pivot arm 132 is depicted in a second, coupling position represented by a dash-dot line 146. Contraction of wire 122 will shift first pivot arm 132 to its uncoupling position, represented by dashed line 144, and. Alloy-training post 126 and stop post 130 serve as stops for first pivot arm 132, to limit the range of motion thereof.

To further described the shape-memory alloy, nickel-titanium (Ni-Ti) wire may be used in this application. One form of nickel-titanium wire is sold under the mark Tinel® by Raychem Corporation. Other brands are available through a variety of sources which are well known to hobbyists. Ni-Ti alloy has two stable crystalline phases: a high-temperature phase, known as austenite, and a low-temperature phase, known as martensite. A transformation temperature defines the division between the high-temperature phase and the low-temperature phase. In the high-temperature phase, the crystal structure is body-centered cubic. When the alloy is cooled below its transformation temperature, the austenitic structure undergoes a diffusionless shear transformation to a high-twinned martensite crystal structure. In the martensitic phase, the twinned structure may be mechanically deformed to a parallel registry. This deformation may be up to eight percent. The structure will remain in the deformed shape so long as the alloy is below the transformation temperature. When the deformed martensitic structure is warmed through its transformation temperature, it immediately returns to the austenitic form. If no outside restrictions are placed on the structure, the alloy will return to its original shape. If the deformed martensitic structure is constrained, such as by physically preventing it from returning to its original shape, a stress is generated on heating through the transformation temperature.

Thus, biasing mechanism 150 is effective to stress the unheated, martensitic phase wire to allow first pivot arm 132 of electromotive actuator 120 to return to its coupling position. When a current is passed through wire 122, the wire, through resistance, heats, passing through the transformation temperature and returns to its austenitic form, thereby shifting first pivot arm 132 to its uncoupling position. In the embodiment depicted herein, a current of 200–250 milleamps, at five volts, is sufficient to take shape-memory alloy 122 through its transformation temperature in approximately one-quarter second. Once the electrical current to wire 122 is discontinued, the wire will return to its martensitic phase in approximately five seconds. As depicted herein, wire 122 has a length of about 5 7/16 inches (13.79 cm), and a diameter of about 0.002 inches (0.51 mm) in its austenitic form. Wire 122 is stretched from an original length of about 5 5/16 inches (13.49 cm) to the requisite length for mounting on electromotive actuator 120. Many of the components of actuator 120 may be formed of ABS plastic, thereby providing insulation for wire 122 about alloy-training posts 126 and 128. Wire 122, when activated, does not get hot enough to melt the ABS plastic.

Figure 9:
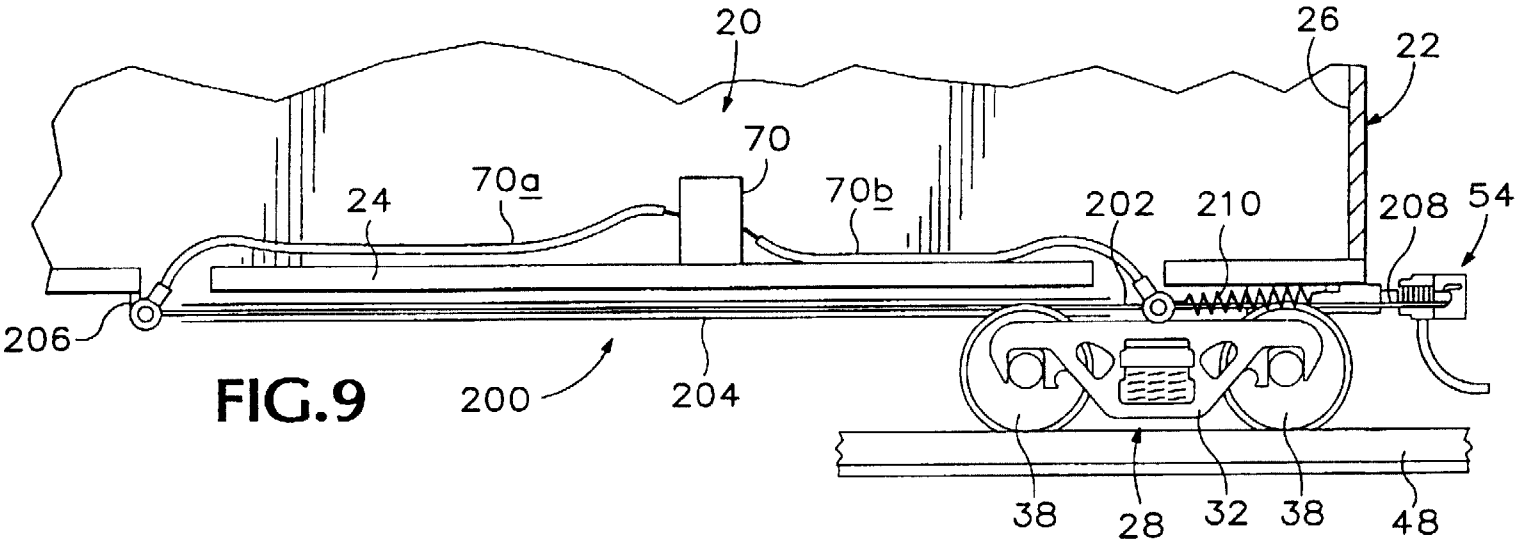
FIG. 9 is a side view of a third embodiment of the electromotive actuator of the invention.
Figure 10:
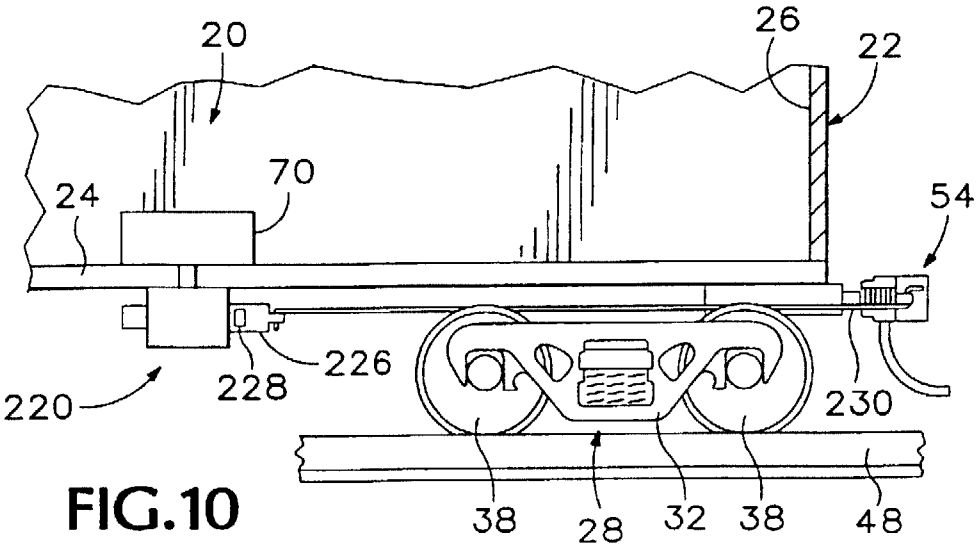
FIG. 10 is a side view of a fourth embodiment of the electromotive actuator of the invention.

The electromotive actuator of the invention may take other forms than depicted in FIGS. 3, 4 and 5. Such forms may include a solenoid attached to a free-floating pivot arm, which has a connector attached to either end thereof. In some instances, it may be possible and desirable to connect a length of shape-memory alloy, with or without a connector, to a coupler. A solenoid may be attached directly to a connector, which is in turn attached to a coupler. These last two embodiments are depicted in FIG. 9 and FIG. 10, respectively.

NMRA has adopted an Electrical Standard, S-9.1, revised January, 1994, and a Service Mode Digital Command Control Standard, RP-9.2.3, revised Jun. 28, 1994, for all scales of model railroads. A number of manufacturers make command control systems that correspond to the NMRA standard. Additionally, a number of proprietary command control systems are available. Whether a system meets the NMRA standard or contains proprietary technology, the systems are designed to operate model railroads without the conventional hard wiring, which controls powered rolling stock through variations in track voltage. In the command and control systems, a constant voltage is applied to the tracks and the amount of voltage reaching the motor in a model railroad locomotive is controlled by electronics in a signal-receiving unit. The wheels of a locomotive, and possibly an attached tender, provide power pickup from the rails. In the case of a steam powered locomotive, some form of on-board power supply is provided to power the electronic speed controls found in such units.

A control unit is operable by a model railroader to control direction and speed of the locomotive. A decoder may be installed in a locomotive, or in another unit of rolling stock, which will received signals from the control unit. In the case of a locomotive, the decoder is operable to control speed and direction and to operate a number of accessories, such as lights on the locomotive. There are, however, additional circuits available in a locomotive decoder, which may be used with the remote uncoupler mechanism of the invention. Other types of decoders may be provided for use in non-powered rolling stock units, or may be used to control turnouts and other accessories. The decoder, regardless of whether it is installed in locomotive or in a unit of non-powered rolling stock, upon receipt of a signal from the command control module, will transmit a trigger signal to power supply 70, which trigger signal will activate an appropriate switch or relay, thereby provided power to the electromotive actuator. Termination of signal from the command control unit will result in a cessation of trigger signal generated by signal-receiving mechanism 72, which will stop the flow of power from power supply 70 to the electromotive actuator.

Upon receipt of an appropriate signal by signal-receiving mechanism 72, power supply 70 is activated, thereby applying power to shape-memory alloy 122. This causes the alloy to change its shape, in the form of contracting, which decreases the overall length of wire 122, thereby shifting crank arm in the direction of arrow 148, and shifting pivot arm 132 to its first, uncoupling position. When the trigger signal ceases, power supply 70 is deactivated, allowing wire 122 to return to its original shape and length, thereby allowing pivot arm 132 to return to its second, coupling position. To assist this relaxation process, a biasing mechanism 150 is associated with crank 138, which is operable to bias the crank to a position which maintains pivot arm 132 in its coupled condition. In the preferred embodiment of electromotive actuator 120, biasing mechanism 150 is a coil spring which has one end fixed to base 64 and which has the other end thereof attached to crank 138.

Turning now to FIG. 9, a third embodiment of an electromotive actuator is depicted generally at 200. Actuator 200 includes a length of wire 202 which is encased in an insulated sleeve 204 along a portion of its length. Wire 202 and sleeve 204 extend along the underside of an undercarriage 24. Wire 202 is fixed to undercarriage 24 by an insulated bracket 206 at one end thereof, which bracket insulates wire 202 from undercarriage 24. Wire 202 is electrically connected to one lead **70*a* from power supply 70. The other end of wire 202 is connected to a connector 208 and a return spring 210. Connector 208 is attached to a coupler 54, as has been previously described herein. Wire 202 is insulated from connector 208 and return spring 210, but is electrically connected to the other lead 70*b* from power supply 70. When power is applied to wire 202, it will contract, as has been described in connection with wire 122 of actuator 120. When power is removed, wire 202 will return to its normal length, under the influence of return spring 210. Wire 202 is required to contract approximately ⅛ inch (0.31 cm) in order to shift coupler 54** from its coupler condition to its uncoupled condition. A Ni-Ti wire having a length of between five and six inches (12.7 to 15.24 cm) is of sufficient length to provide this amount of contraction under the power and current specification previously described herein.

FIG. 10 shows a single solenoid electromotive actuator generally at 220. Actuator 220 includes a powered solenoid 222 which is connected to power supply 70. Solenoid 222 includes a coil and housing 224 and a solenoid arm 226. A return spring 228 may be located on solenoid arm 226, and is operable to return arm 226 to a coupled position, although, in most instances, the conventional self-centering mechanism of coupler 54 is sufficient to return the coupler to its coupled condition. A connector 230 extends between solenoid arm 226 and coupler 54, and is attached to coupler 54 in the manner previously described herein. When power is applied to coil 224, arm 226 shifts, thereby shifting coupler 54 to its uncoupled condition. When the power is disconnected, arm 226 is returned to a coupling position by return spring 228, and coupler 54 shifts to its coupled condition.

Figure 11:
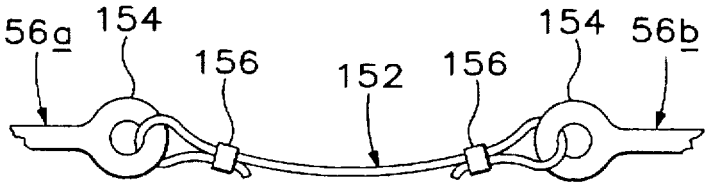
FIGS. 11–13 depict a variety of flexible links of the invention, which are located intermediate the ends of a connector of the invention.
Figure 12:
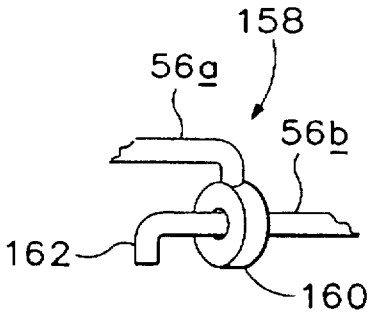
Figure 13:
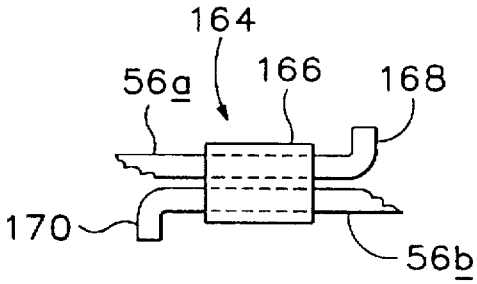

Turning now to FIGS. 11–13, a variety of flexible links of the invention are depicted. As previously noted, flexible links, such as that generally depicted at 57 in FIGS. 1 and 2, may be used with connector 56 to allow free movement of coupler 54 within its pre-determined arc. To this end, a variety of flexible links are provided, which may be used by the model railroader according to the requirements of a particular piece of rolling stock.

A first type of flexible link is depicted generally at 152 in FIG. 11. Flexible link 152 is connected through eyes 154, which are located at ends of connector portions **56*a* and 56*b*. Flexible link 152 may take the form of a piece of thread, or a length of monofilament polymer material, which extends between eyes 154, and which is secured to each eye either by means of a knot or by means of a compression fitting, such as depicted at 156**.

Turning to FIG. 12, another form of flexible link is depicted generally at 158. The second form of flexible link incorporates an eye structure 160, located on the end of connector portion **56*a*, wherein eye structure 160 is formed at ninety degrees to the longitudinal axis of connector portion 56*a*. Connector portion 56*b* passes through eye structure 160 and is retained therein by means of a bend 162**.

A third type of flexible link is depicted generally at 164 in FIG. 13. This type of flexible link includes a sleeve 166 through which connector portions **56*a* and 56*b* are passed. The connector portions are then held in place by means of bends 168, 170**.

It should be readily apparent to those of ordinary skill in the art that other varieties and forms of flexible links may be used to accomplish the desired goal.

As previously noted, power supply 70 may take a variety of forms. One such form is to provide a battery mount within rolling stock unit 22 and to provide small batteries, such as AAA batteries therein. Three such batteries will provide sufficient voltage and current to operate electromotive actuator 52 or 120 for a reasonable period of time. A nine volt battery and a regulator therefor may also be provided as a source of on-board power.

Another form of power supply is to provide pickups from the energized rails. This technique is well known to model railroaders and may be accomplished in a number of ways. One such way is to provide a truck having an electrically conductive wheel on one end of an electrically conductive axle, with the wheel on the other end of the axle either being insulated or being formed of a plastomer material. The truck side frame members may be formed of a plastomer material, or may be insulated from the axle. The second axle on the truck is configured as the first, however the metallic wheel is located on the other side of the truck. Pickup brushes (not shown) may be placed in contact with the axles and connected to power supply 70. Leads 172 (FIG. 6) provide a power transmission mechanism from the trucks to the power supply 70, in the preferred embodiment.

Another form of power supply which may be used, although particularly suited to outdoor railroads, is a solar power cell, which may be mounted on top of body 26 and which may serve as a power source to power supply 70. Outdoor (garden) railroads may be steam powered and my not use energized rails, requiring that an alternate energy source be provided for power supply 70.

Although a preferred embodiment of the invention, and a variation thereto have been disclosed herein, it should be appreciated that further variations and modifications may be made thereto without departing from the scope of the invention as defined in the appended claims.

I claim:

1. A model railroad remote uncoupler mechanism connected to a signal-receiving mechanism and a self-centering coupler, wherein the coupler is mounted, for arcuate movement within a substantially horizontal plane, on a unit of model railroad rolling stock, and is shiftable between a coupled condition, wherein the coupler engages a coupler on another unit of rolling stock, and an uncoupled condition, and which includes a coupler shank, a coupler head, a coupler knuckle mounted on the coupler head for pivoting movement relative thereto between a closed position and an open position, and a biasing mechanism extending between the head and the knuckle to bias the knuckle to its closed position, comprising:

an electromotive actuator which is activated by the signal-receiving mechanism, including a prime mover effectuating the uncoupling action, a pivot arm connected to said prime mover wherein said prime mover is operable to shift said pivot arm to a first, uncoupling position; and a spring biasing mechanism for biasing said pivot arm to a second, coupling position;

a power supply for said electromotive actuator; and a connector extending between said pivot arm and the coupler for shifting the knuckle between its closed position and its open position.

2. The uncoupler mechanism of claim 1 wherein said power supply is carried on-board the rolling stock.

3. The uncoupler mechanism of claim 1 wherein said power supply comprises power supplied to spaced-apart rails on which the rolling stock rolls, and which includes a pickup mechanism for transferring power from the rails to said electromotive actuator.

4. The uncoupler mechanism of claim 1 wherein said prime mover includes a solenoid having an armature, wherein said armature is attached to said pivot arm.

5. The uncoupler mechanism of claim 1 wherein said prime mover includes a shape-memory alloy and wherein said electromotive actuator includes plural, alloy-training posts thereon for training said shape-memory alloy thereabout, including at least one alloy-training post carried on said pivot arm, wherein, with an electrical current applied to said shape-memory alloy, said shape-memory alloy changes shape about said alloy-training posts, thereby shifting said pivot arm to said uncoupling position.

6. The uncoupler mechanism of claim 1 wherein said connector includes a flexible link intermediate the ends thereof.

7. A model railroad remote uncoupler mechanism connected to a signal-receiving mechanism and a self-centering coupler, wherein the coupler is mounted, for swinging movement within a pre-defined arc in a substantially horizontal plane, on a unit of model railroad rolling stock, and is shiftable between a coupled condition, wherein the coupler engages a coupler on another unit of rolling stock, and an uncoupled condition, which rolls on spaced-apart rails, wherein the coupler includes a coupler shank, a coupler head having a head dog formed thereon, a coupler knuckle mounted on the coupler head for pivoting movement relative thereto between an open position and a closed position, and having a knuckle dog formed thereon; and a biasing mechanism extending between the head dog and the knuckle dog to bias the knuckle to its closed position, comprising:

an electromotive actuator which is activated by the signal-receiving mechanism, including a prime mover effectuating the uncoupling action, an elongate pivot arm connected to said prime mover wherein said arm has a pivot point near the center thereof, and wherein said prime mover is operable to shift said pivot arm to a first, uncoupling position, and which further includes a spring biasing mechanism for biasing said pivot arm to a second, coupling position;

a power supply for said electromotive actuator; and a connector extending between said pivot arm and the coupler for shifting the knuckle between its closed position and its open position.

8. The uncoupler mechanism of claim 7 wherein said connector is attached to said knuckle dog of said coupler.

9. The uncoupler mechanism of claim 7 wherein said prime mover includes a solenoid having an armature, wherein said armature is attached to said pivot.

10. The uncoupler mechanism of claim 7 wherein said prime mover includes a shape-memory alloy, and wherein said electromotive actuator includes plural, alloy-training posts thereon for training said shape-memory alloy thereabout, wherein at least one alloy-training post is connected to said pivot arm, wherein, with an electrical current applied to said shape-memory alloy, said shape-memory alloy changes shape about said alloy-training posts, thereby shifting said pivot arm to said uncoupling position.

* * * * *